US009573073B1

(12) United States Patent
Mazur et al.

(10) Patent No.: US 9,573,073 B1
(45) Date of Patent: Feb. 21, 2017

(54) STUFFED ANIMAL/GARMENT SYSTEM

(71) Applicants: Catherine E. Mazur, Trinity, FL (US); Gary M. Mazur, Trinity, FL (US)

(72) Inventors: Catherine E. Mazur, Trinity, FL (US); Gary M. Mazur, Trinity, FL (US)

( * ) Notice: Subject to any disclaimer, the term of this patent is extended or adjusted under 35 U.S.C. 154(b) by 0 days.

(21) Appl. No.: 14/269,870

(22) Filed: May 5, 2014

Related U.S. Application Data

(60) Provisional application No. 61/839,957, filed on Jun. 27, 2013.

(51) Int. Cl.
*A63H 3/00* (2006.01)
*A63H 33/00* (2006.01)

(52) U.S. Cl.
CPC ..... *A63H 33/004* (2013.01)

(58) Field of Classification Search
CPC ..... A63H 33/004; A63H 3/00
USPC ..... 446/28, 72, 73, 74, 369
See application file for complete search history.

(56) References Cited

U.S. PATENT DOCUMENTS 4,064,562 A * 12/1977 Kenny ..... 2/84
4,404,689 A * 9/1983 DeWan ..... 2/247
4,423,834 A * 1/1984 Rush ..... 224/153
4,543,669 A * 10/1985 Katz ..... 2/84
4,563,159 A * 1/1986 Hills et al. ..... 446/74
4,590,633 A * 5/1986 Pickens ..... 5/482
4,734,948 A * 4/1988 Danova ..... 5/502
4,739,529 A * 4/1988 Mills ..... 5/413 R
4,754,512 A * 7/1988 Chao-Yang ..... 5/482
4,793,575 A * 12/1988 Butler ..... 244/148
4,856,131 A * 8/1989 Mills ..... 5/413 R
4,874,344 A * 10/1989 Kanter ..... 446/268
5,165,111 A * 11/1992 Lieberman ..... 2/94
5,201,073 A * 4/1993 Spanier ..... 2/49.2
5,210,881 A * 5/1993 Stocker et al. ..... 2/247
5,308,275 A * 5/1994 Kornbleuth ..... 446/28
5,326,300 A * 7/1994 Sonders ..... 446/74
5,374,192 A * 12/1994 Marble et al. ..... 434/236
5,791,963 A * 8/1998 Lieberman ..... 446/27
6,126,507 A * 10/2000 Lieberman ..... 446/327
6,230,331 B1 * 5/2001 Aguilar et al. ..... 2/209.11
6,279,167 B1 * 8/2001 Johnson et al. ..... 2/209.13
6,343,968 B1 * 2/2002 Louie et al. ..... 446/72
6,421,852 B1 * 7/2002 Shao ..... 5/413 R
6,427,267 B1 * 8/2002 Turner ..... 5/482
6,598,248 B1 * 7/2003 Ong ..... 5/636
6,751,806 B2 * 6/2004 Hinnant ..... 2/108
7,374,071 B2 * 5/2008 Lavelle ..... 224/153
D590,131 S * 4/2009 Rogondino ..... D2/831
D590,132 S * 4/2009 Rogondino ..... D2/831
D590,133 S * 4/2009 Rogondino ..... D2/831
D590,134 S * 4/2009 Rogondino ..... D2/831
D590,135 S * 4/2009 Rogondino ..... D2/831
D591,028 S * 4/2009 Rogondino ..... D2/831
7,883,391 B1 * 2/2011 Asomani ..... 446/28

(Continued)

*Primary Examiner* — Melba Bumgarner
*Assistant Examiner* — Joseph B Baldori

(57) ABSTRACT

A stuffed animal has a primary passageway and an interior chamber. Primary fasteners open and close the primary passageway. A garment has a secondary passageway extending through the garment. A tunnel is defined between a first fabric section and a second fabric section. Stitching attaches the first fabric section to the stuffed animal adjacent to a left free edge. Second stitching attaches the second fabric section to the stuffed animal adjacent to a right free edge.

1 Claim, 11 Drawing Sheets

(56) References Cited

U.S. PATENT DOCUMENTS

| | | | | |
|---|---|---|---|---|
| 7,892,064 | B2 * | 2/2011 | Carruth | 446/73 |
| 8,864,544 | B2 * | 10/2014 | Anderman et al. | 446/27 |
| 2005/0101220 | A1 * | 5/2005 | Jackson | 446/369 |
| 2008/0115254 | A1 * | 5/2008 | Galkov | 2/108 |
| 2009/0081921 | A1 * | 3/2009 | Urueta | 446/369 |
| 2009/0298380 | A1 * | 12/2009 | Tseng et al. | 446/28 |
| 2011/0070802 | A1 * | 3/2011 | Li et al. | 446/72 |
| 2012/0202401 | A1 * | 8/2012 | Postlethwaite | 446/72 |
| 2012/0238178 | A1 * | 9/2012 | Wadhwani | 446/72 |
| 2012/0289116 | A1 * | 11/2012 | Beuerle | 446/72 |
| 2012/0329358 | A1 * | 12/2012 | Cupid | 446/73 |

* cited by examiner

FIG. 1
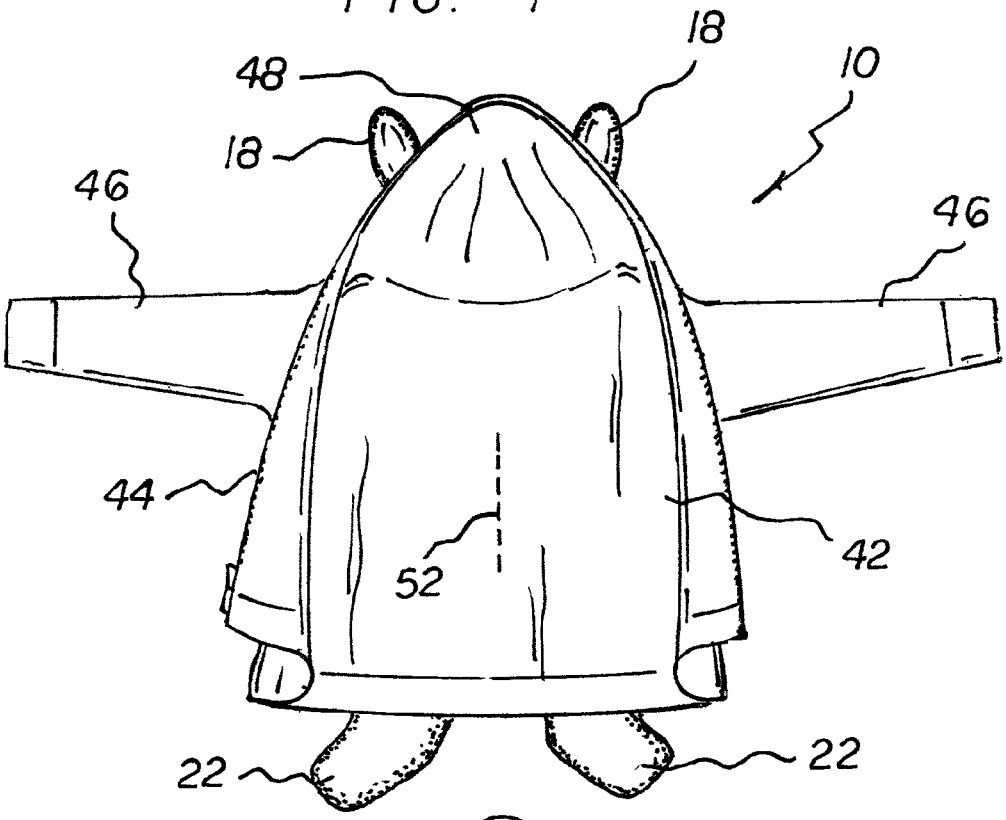
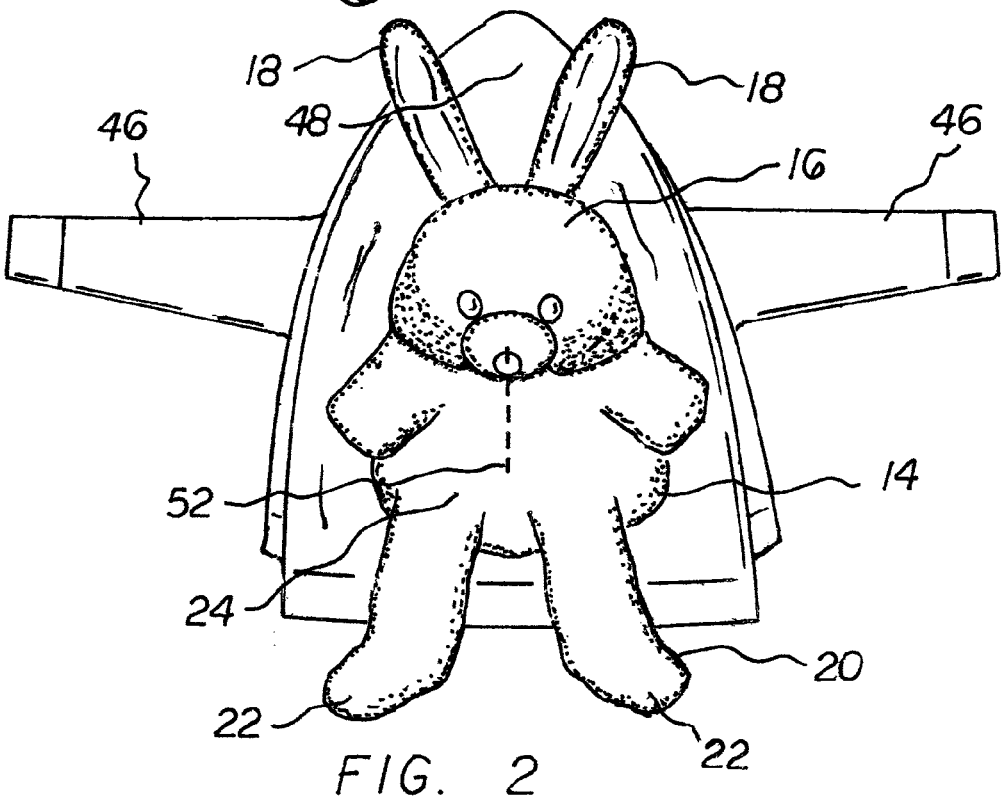
FIG. 2

FIG. 11
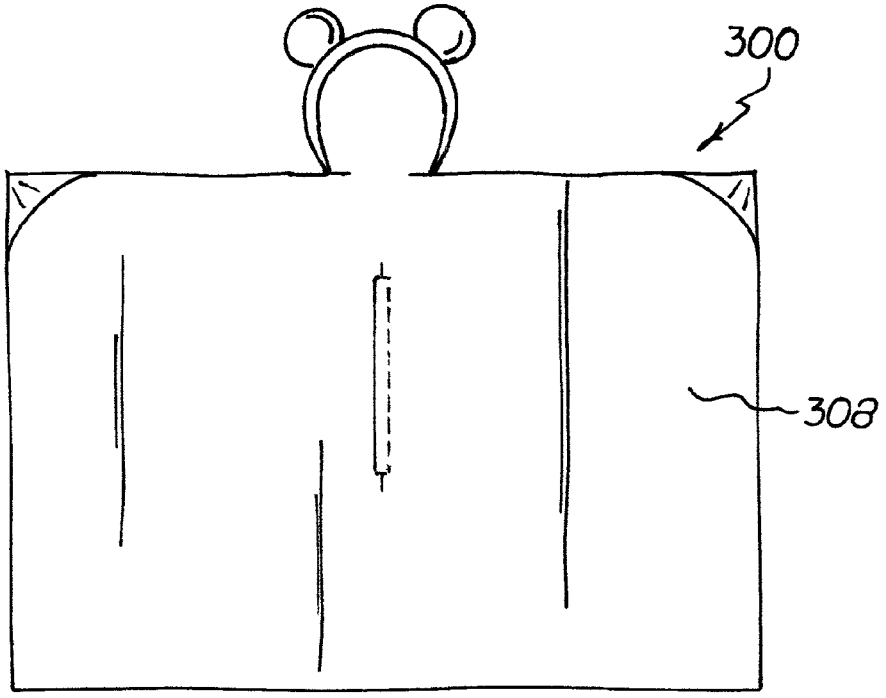
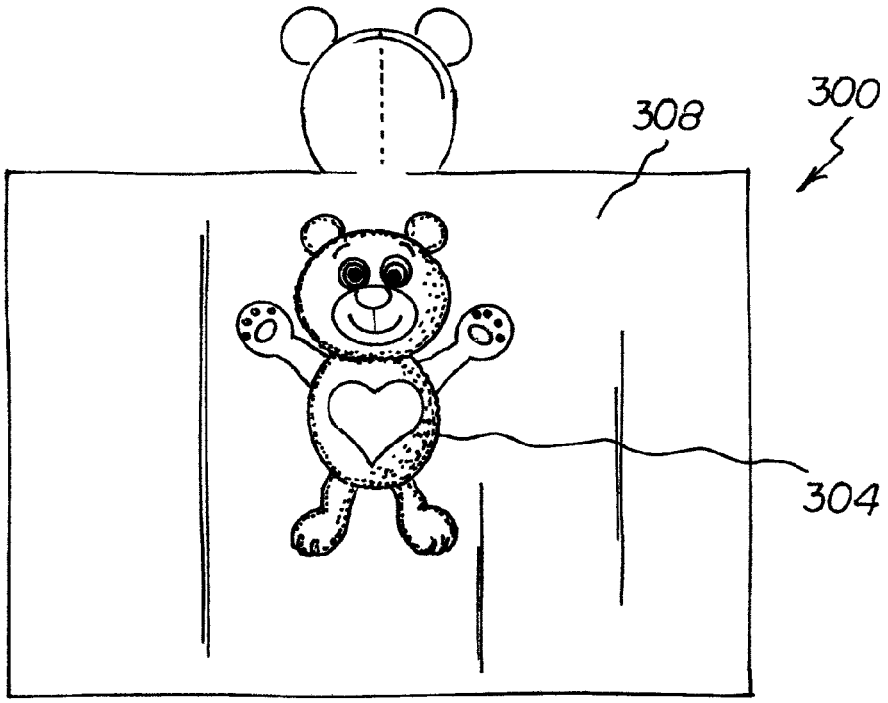
FIG. 12

FIG. 19
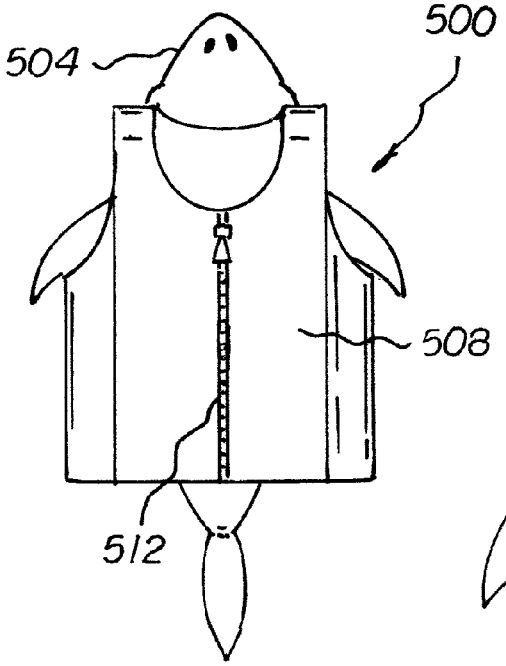
FIG. 20
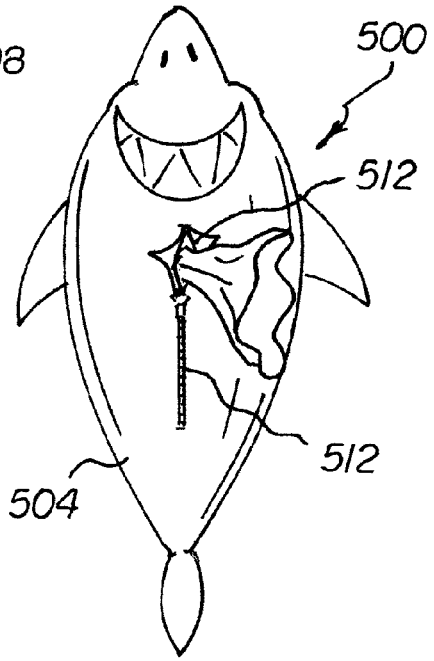
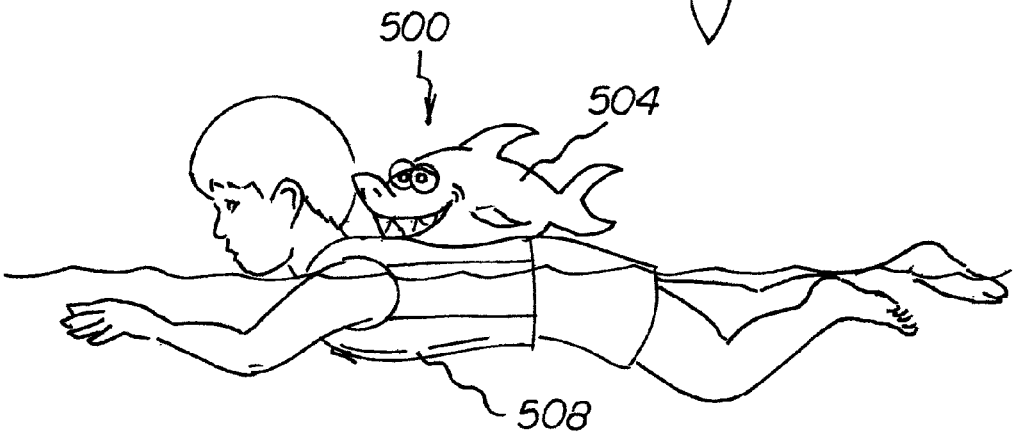
FIG. 21

FIG. 22
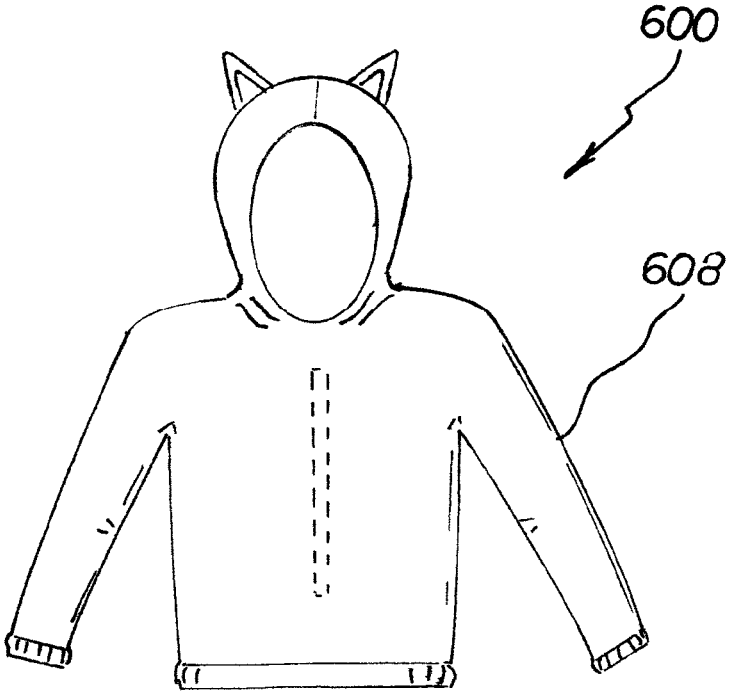
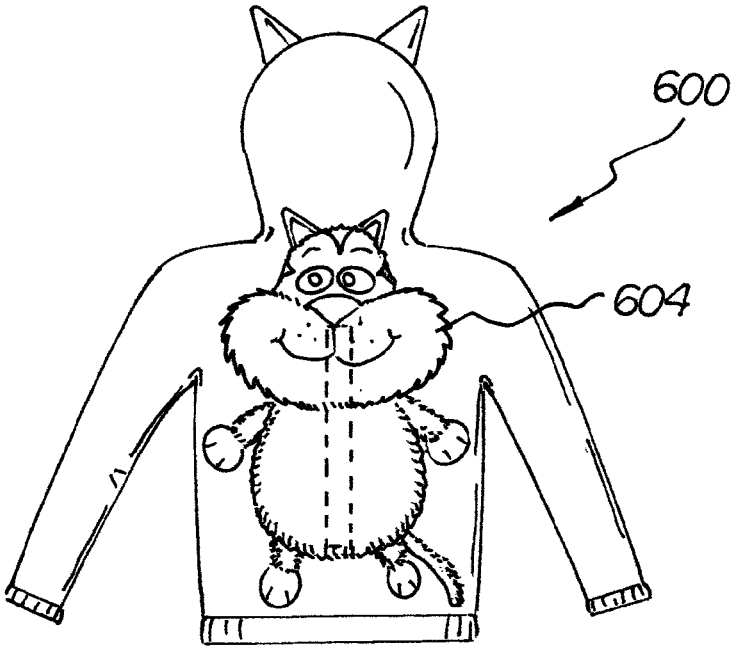
FIG. 23

STUFFED ANIMAL/GARMENT SYSTEM

BACKGROUND OF THE INVENTION

Related Application

The application is based upon Provisional Application 61/839,957 filed Jun. 27, 2013 the subject matter of which is incorporated herein by reference.

Field of the Invention

The present invention relates to a stuffed animal/garment system and more particularly pertains to clothing a wearer and providing an associated stuffed animal, the garment being positionable interiorly of the stuffed animal when playing with the stuffed animal, the garment being positionable exteriorly of the stuffed animal for wearing, the providing and the wearing and the stuffing being done in a safe, convenient, and economical manner. In an alternate embodiment of the invention, the stuffed animal converts to a backpack.

Description of the Prior Art

The use of garment systems of known designs and configurations is known in the prior art. Note for example: U.S. Pat. No. 4,404,689 issued Sep. 20, 1983, to DeWan; U.S. Pat. No. 4,543,669 issued Oct. 1, 1985, to Katz; and U.S. Patent Application Publication No. 2008/0115254 published May 22, 2008, to Galkov. More specifically, garment systems of known designs and configurations previously devised and utilized for the purpose of clothing a wearer are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a stuffed animal garment system that provides a stuffed animal with which to play and clothing a user with a garment, the playing with the stuffed animal and the wearing of the garment and the converting between the stuffed animal and the garment being done in a safe, convenient, and economical manner.

In this respect, the stuffed animal garment system according to the present invention substantially departs from the conventional concepts and designs of the prior art, and in doing so provides an apparatus primarily developed for the purpose of providing a stuffed animal with which to play and clothing a user with a garment.

A significant difference from the prior art is the actual hole/opening in the stuffed animal and garment that provides the mechanism for stuffing the garment into the stuffed animal.

Therefore, it can be appreciated that there exists a continuing need for a new and improved stuffed animal garment system which can be used for providing a stuffed animal with which to play and clothing a user with a garment. In this regard, the present invention substantially fulfills this need.

SUMMARY OF THE INVENTION

In view of the foregoing disadvantages inherent in the known types of garment systems of known designs and configurations now present in the prior art, the present invention provides an improved stuffed animal garment system. As such, the general purpose of the present invention, which will be described subsequently in greater detail, is to provide a new and improved stuffed animal garment system and method which has all the advantages of the prior art and none of the disadvantages.

To attain this, the present invention essentially comprises a stuffed animal having a primary passageway and an interior chamber. Primary fasteners open and close the primary passageway. A garment has a secondary passageway extending through the garment. A secondary fastener closes the secondary passageway. This secondary fastener is optional, so that it may be fastened or remains as an opening. A tunnel is defined between a first fabric section and a second fabric section. Stitching attaches the first fabric section to the stuffed animal adjacent to a left free edge. Second stitching attaches second fabric section to the stuffed animal adjacent to a right free edge.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stuffed animal garment system which has all of the advantages of the prior art garment systems of known designs and configurations and none of the disadvantages.

It is another object of the present invention to provide a new and improved stuffed animal garment system which may be easily and efficiently manufactured and marketed.

It is further object of the present invention to provide a new and improved stuffed animal garment system which is of durable and reliable constructions.

An even further object of the present invention is to provide a new and improved stuffed animal garment system which is susceptible of a low cost of manufacture with regard to both materials and labor, and which accordingly is then susceptible of low prices of sale to the consuming public, thereby making such stuffed animal garment system economically available to the buying public.

Lastly, another object of the present invention is to provide a stuffed animal garment system for providing a stuffed animal with which to play and clothing a user with a garment, the playing with the stuffed animal and the wearing of the garment and the converting between the stuffed animal and the garment being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a stuffed animal/garment system constructed in accordance with the principles of the present invention.

FIG. 2 is a rear elevational view of the system illustrated in FIG. 1.

FIG. 11 is a front elevational view of a deployed garment, hooded wrap, constructed in accordance with an alternate embodiment of the invention, this hooded wrap could be a towel or a blanket.

FIG. 12 is a rear elevational view of the deployed garment of FIG. 11.

FIG. 19 is a front elevational view of a deployed garment, a swimming vest, constructed in accordance with yet an alternate embodiment of the invention, the closures being opened and closed by zippers.

FIG. 20 is a rear elevational view of the partially deployed garment of FIG. 19, the animal being a fish.

FIG. 21 is a side elevational view of the system shown in FIGS. 19 and 20, the system being deployed and in use.

FIG. 22 is a front elevational view of a deployed garment, a hooded sweater or sweatshirt, constructed in accordance with an alternate embodiment of the invention.

FIG. 23 is a rear elevational view of the system shown in FIG. 22, the animal being a cat.

The same reference numerals refer to the same parts throughout the various Figures.

DESCRIPTION OF THE PREFERRED EMBODIMENT

Figure 3:
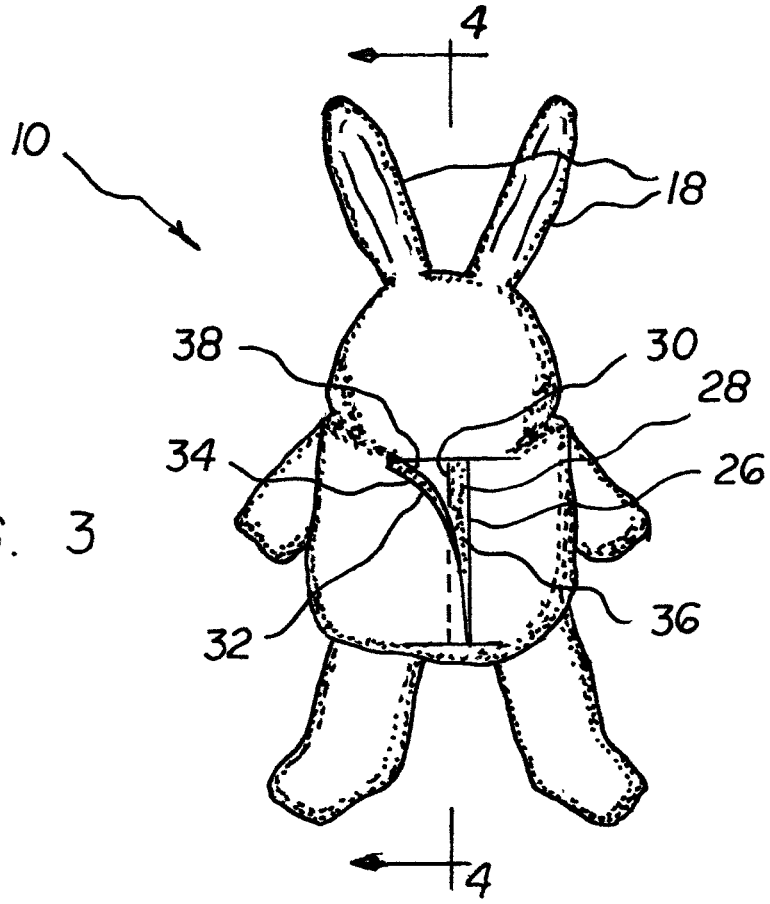
FIG. 3 is a rear elevational view of the stuffed animal of the prior Figures with a jacket stuffed interiorly thereof.

With reference now to the drawings, and in particular to FIG. 1 thereof, the preferred embodiment of the new and improved stuffed animal garment system embodying the principles and concepts of the present invention and generally designated by the reference numeral 10 will be described.

The present invention, the stuffed animal garment system 10 is comprised of a plurality of components. Such components in their broadest context include a stuffed animal, a garment, a first fabric section, a second fabric section, and stitching. Such components are individually configured and correlated with respect to each other so as to attain the desired objective.

In the preferred embodiment of the stuffed animal/garment system, designated by reference numeral 10, first provided is a stuffed animal 14. The stuffed animal in this preferred embodiment is in the form of a rabbit. It should be understood that the stuffed animal could be the representation of any other animal or doll or imaginary creature, or the like in other embodiments of the invention. The stuffed animal has an upper section 16. The upper section is in the form of a rabbit head and face. The upper section has upwardly extending ears 18. The stuffed animal has a lower section 20. The lower section is in the form of two legs 22. The legs extend downwardly. The stuffed animal has an intermediate section 24. The intermediate section is in the form of a torso. The intermediate section has an interior chamber. The upper section and the lower section are filled with a resilient stuffing. In this manner a three-dimensional shape is given to the upper section and the lower sections.

The stuffed animal has a front. The front is normally exposed for view. The stuffed animal has a back. The back is normally obscured from view. The back has a slot 26. The slot extends vertically from adjacent to the upper section to adjacent to the lower section. The back adjacent to the slot has an interior flap 28. The interior flap terminates at an interior edge 30. The back adjacent to the slot has an exterior flap 32. The exterior flap terminates at an exterior edge 34. An inner fastener 36 is provided. The inner fastener is provided on the inner flap adjacent to the inner edge facing outwardly. An outer fastener 38 is provided on the exterior flap facing inwardly. The outer fastener is adapted to couple with the inner fastener. In this manner the slot is easily sealed. The interior and exterior fasteners are separable. In this manner entrance to and exit from the chamber is provided. The fasteners are illustrated herein as being hook and loop fasteners. It should be understood, however, that a wide variety of other fasteners may readily be utilized such as buttons, snaps, zippers and the like as a function of the system.

Further provided is a garment 42. The garment is in the form of a jacket. The garment has a torso portion 44. The garment has externally extending arms 46. The garment also has an upwardly extending hood 48, an optional component of the system. The hood extends upwardly in a v-shaped configuration and may have optional character ears on the hood.

Figure 4:
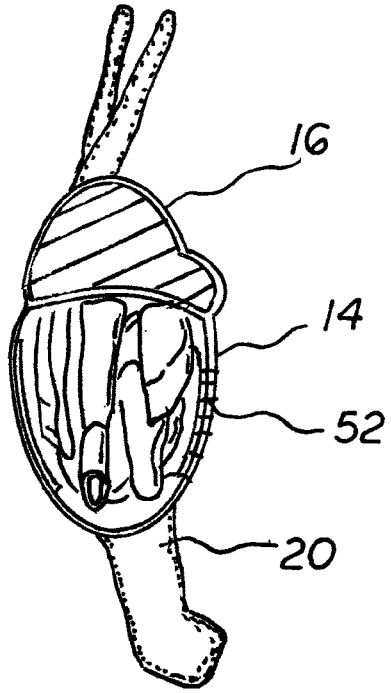
FIG. 4 is a cross sectional view taken along line 4-4 of FIG. 3.
Figure 5:
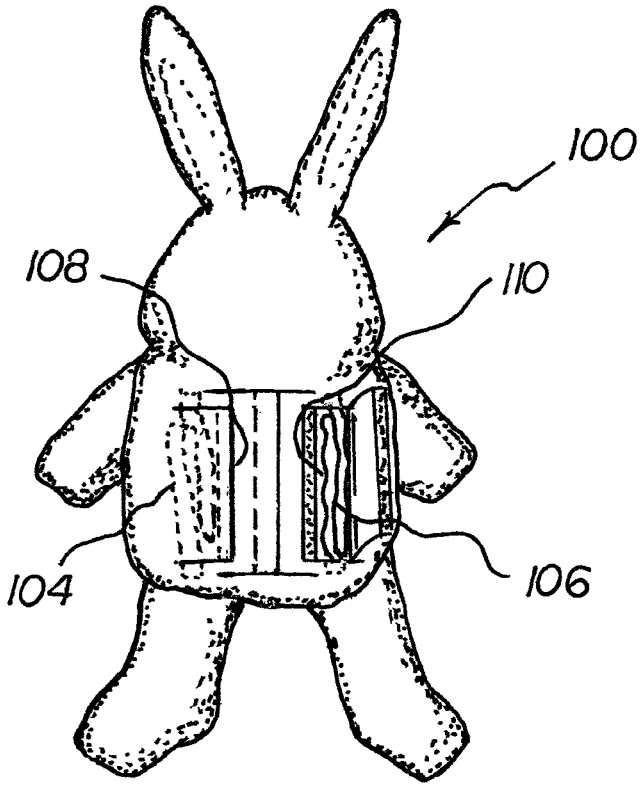
FIG. 5 is a rear elevational view of a stuffed animal similar to FIG. 3 but illustrating an alternate embodiment of the invention wherein the stuffed animal converts to a backpack.
Figure 6:
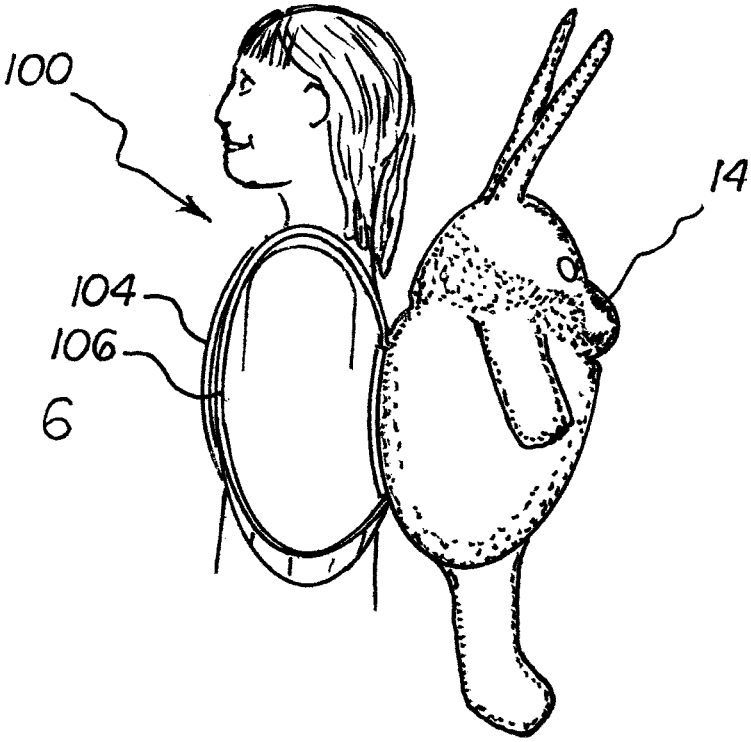
FIG. 6 is a side elevational view of the FIG. 5 embodiment but with a shoulder straps exterior of the stuffed animal secured to a wearer.

In the embodiment illustrated in FIGS. 1 through 4, a minor extent of the ears is visible from the front when worn and a minor extent of the legs is visible below the jacket when worn. This may or may not be the case as it will depend on the stuffed animal/doll/imaginary creature being used.

Provided last is a vertical line of stitching 52. The stitching extends vertically through a central extent of the garment and the back of the intermediate section of the stuffed animal. In this manner the garment may be worn with the stuffed rabbit in back of the wearer. Also in this manner the garment may be inserted into the interior chamber when the fasteners in the stuffed animal are separated.

In an alternate embodiment of the invention, the stuffed animal converts to a backpack. As such, the garment is a pair of laterally spaced shoulder straps 104, 106 with two slots 108, 110. One of the slots is for one of the shoulder straps. The other of the slots is for the other of the shoulder straps.

Figure 7:
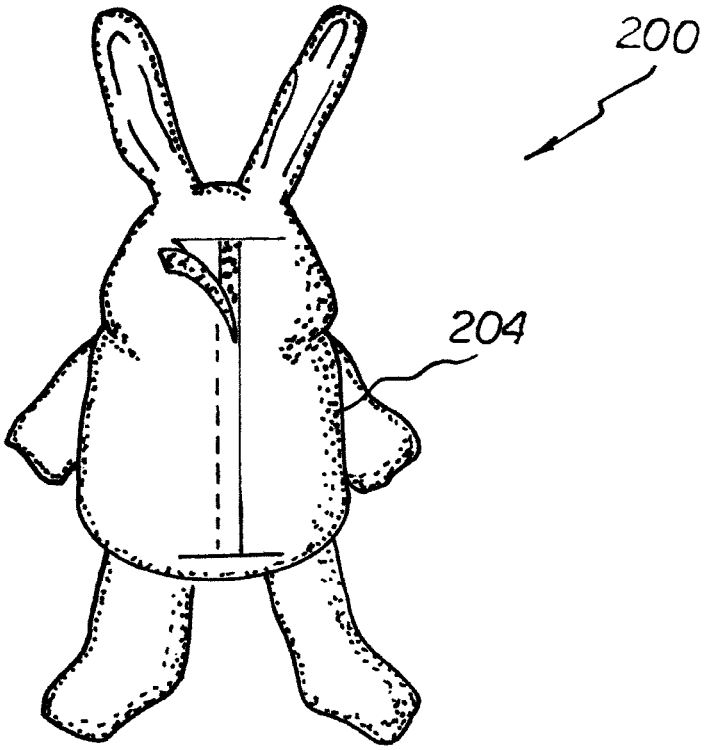
FIG. 7 is a rear elevational view of the primary preferred embodiment of the stuffed animal, a bunny/garment, a jacket system constructed in accordance with the principles of the present invention, the garment being within the animal.
Figure 8:
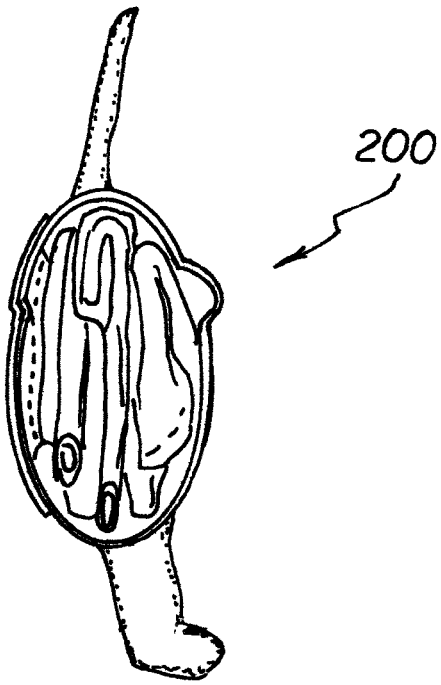
FIG. 8 is a cross sectional view taken along line 8-8 of FIG. 7.
Figure 9:
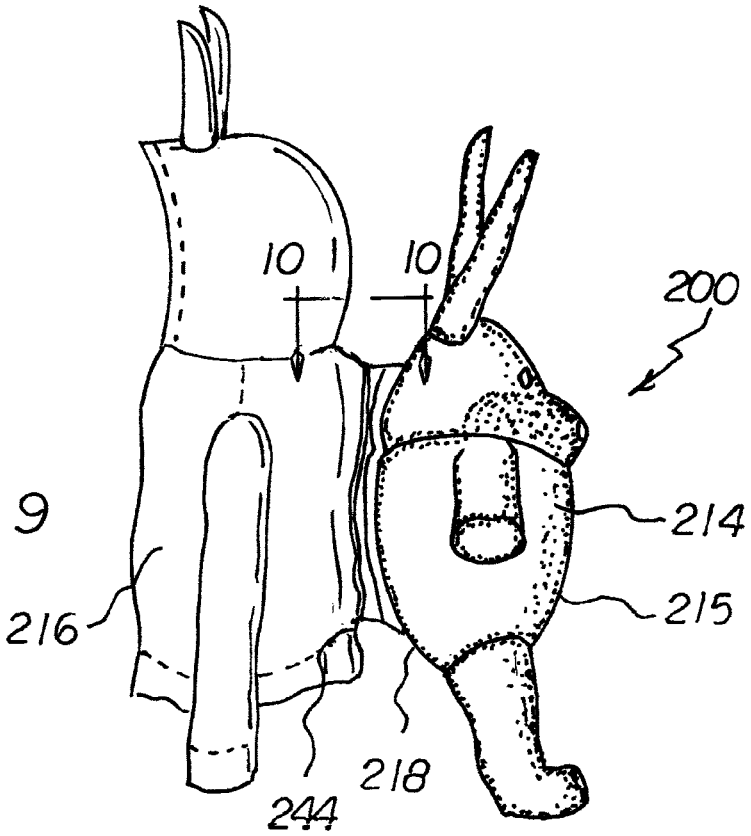
FIG. 9 is a side elevational view of the system of FIGS. 7 and 8 but with the garment deployed outside of the animal.
Figure 10:
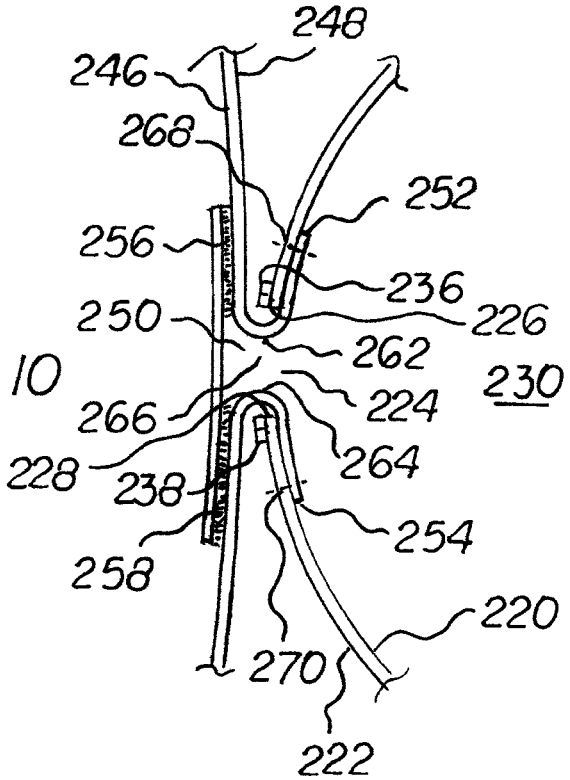
FIG. 10 is a cross sectional view taken along line 10-10 of FIG. 9.
Figure 13:
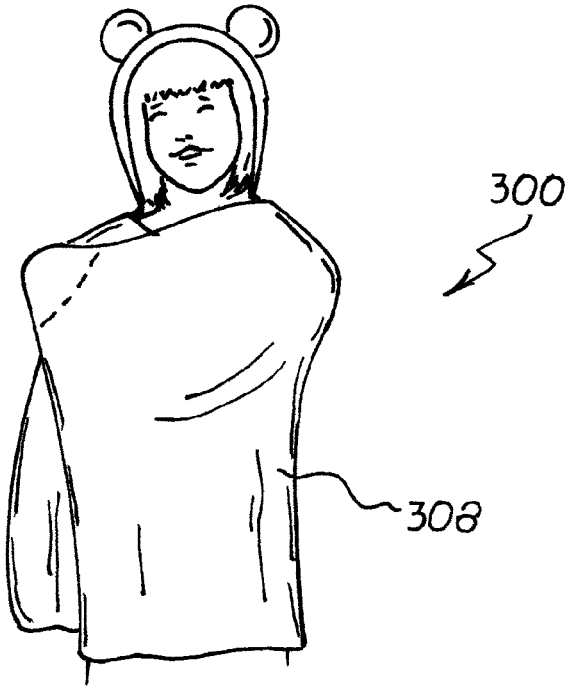
FIG. 13 is a perspective illustration of the garment of FIGS. 11 and 12, the garment being in use.
Figure 14:
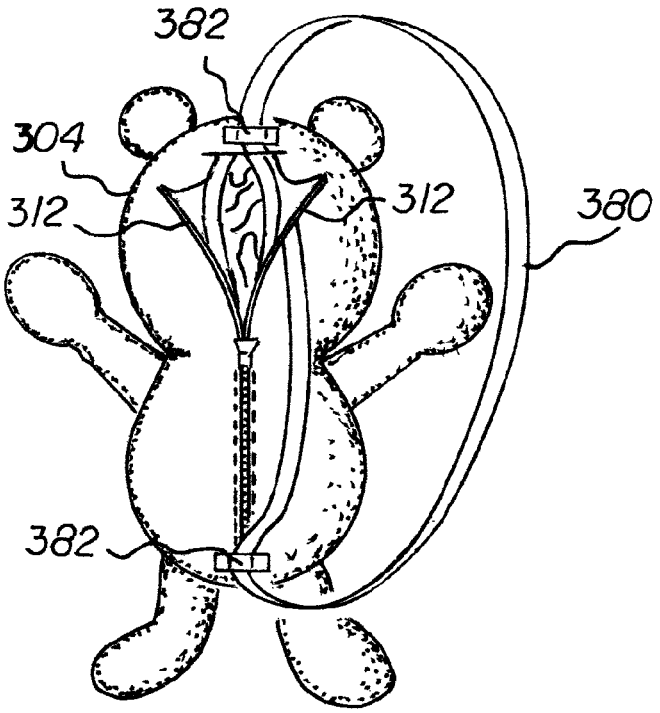
FIG. 14 is a rear elevational view of the animal, a bear, of the FIG. 11-13 embodiment.

Reference is now made to the system illustrated in FIGS. 7-10. Illustrated is the system 200 wherein the stuffed animal is a bunny 204 and the garment is a jacket 208. The primary fasteners are a hook and loop fastener such as a zipper, but could be a variety of fasteners. The secondary fasteners are a sliding fastener. The primary and secondary fasteners extend up into the head and intermediate section. Subsequently, in place of stuffing. the garment is stuffed into the head Reference is now made to the system illustrated in FIGS. 11-14. Illustrated is the system 300 wherein the stuffed animal is a bear 304, the garment is a hooded wrap 308, and the primary and secondary fasteners are sliding fasteners 312. Included is a fabric loop 380 and two elevationally spaced rigid loops 382 extending rearwardly from the stuffed animal for receiving and supporting the fabric loop. The fabric loop is positionable over a shoulder of a user for carrying purposes.

Figure 15:
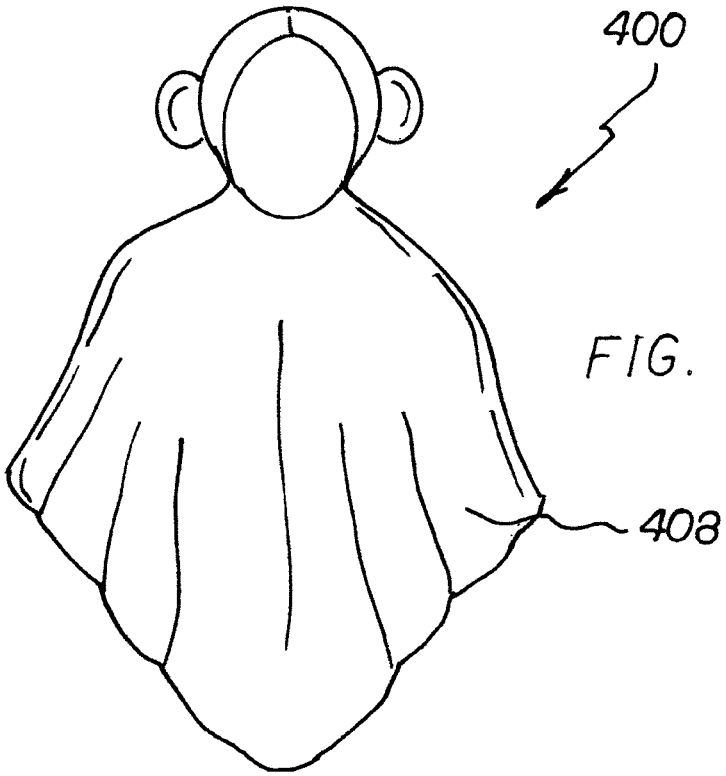
FIG. 15 is a front elevational view of a deployed garment, a poncho, constructed in accordance with another alternate embodiment of the invention.
Figure 16:
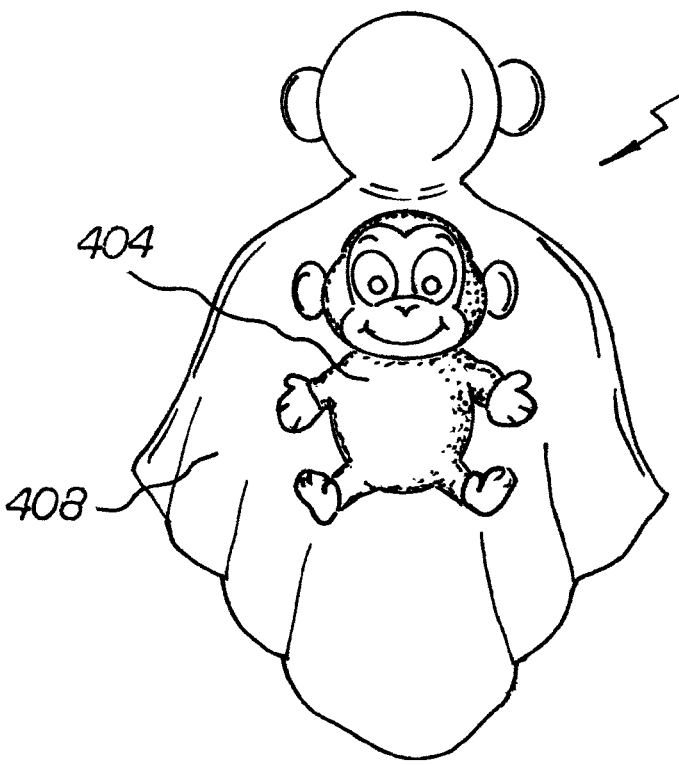
FIG. 16 is a rear elevational view of the deployed garment of FIG. 15, the animal being a monkey.
Figure 17:
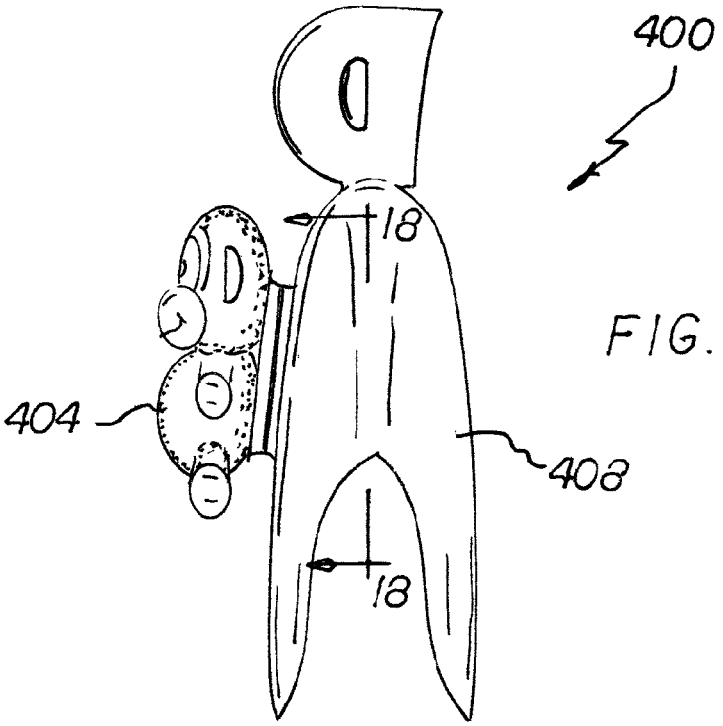
FIG. 17 is a side elevational view of the garment of FIGS. 2 15 and 16, the garment being in use.
Figure 18:
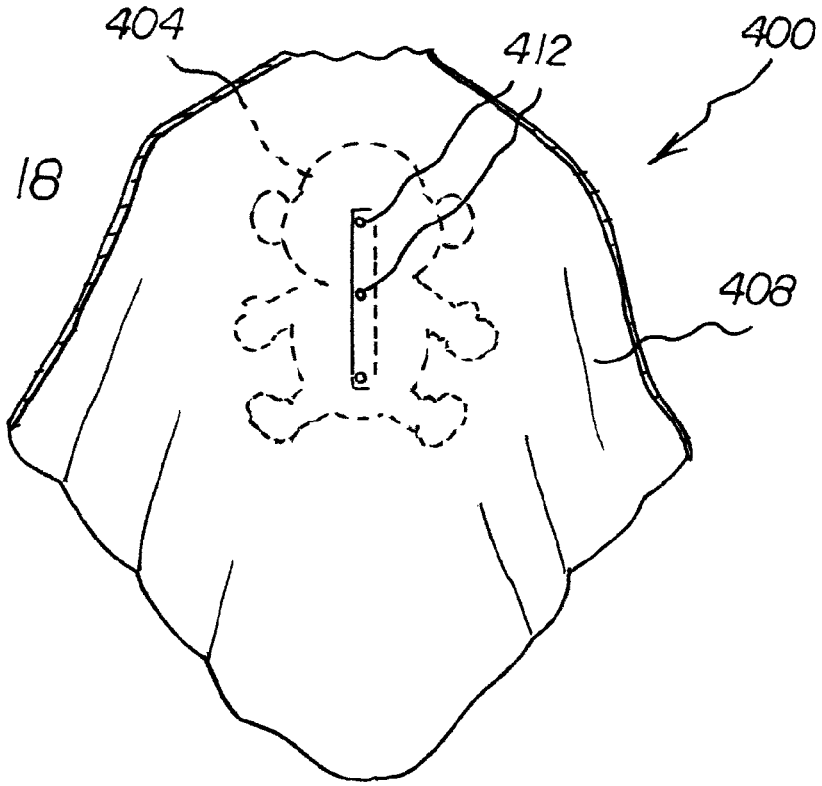
FIG. 18 is a rear elevational view of the garment of FIGS. 15-17, the closures being opened and closed by snaps.

Reference is now made to system illustrated in FIGS. 15-18. Illustrated is the system 400 wherein the stuffed animal is a monkey 404, the garment is a poncho 408, and the primary and secondary fasteners are snaps 412.

Reference is now made to the system illustrated in FIGS. 19-21. Illustrated is the system 500 wherein the stuffed animal is a fish 504 and the garment is a vest 508. The garment is fabricated of a buoyant material. The primary and secondary fasteners are sliding fasteners 512.

Reference is now made to system illustrated in FIGS. 22-23. Illustrated is the system 600 wherein the stuffed animal is a cat 604 and the garment is a sweater 608.

In a preferred embodiment of the invention, a stuffed animal/garment system 200 has a stuffed animal 214 with which to play and a garment 216 to wear. The playing with the stuffed animal and the wearing of the garment and the converting between the stuffed animal and the garment are done in a safe, convenient and economic manner.

Next provided is the stuffed animal 214 having a front 215, a rear 218, an interior surface 220, and an exterior surface 222. The stuffed animal has a primary passageway 224 vertically oriented and extending through the rear of the stuffed animal. The stuffed animal has a left free edge 226 and a right free edge 228 defining the primary passageway there between. The stuffed animal has an interior chamber 230 with access to the chamber being through the primary passageway. A primary sliding fastener 236, 238 is provided on the interior surface adjacent to the left free edge and on the exterior surface adjacent to the right free edge. The primary sliding fastener is adapted to couple together for closing the primary passageway. The primary hook and loop fasteners are adapted to separate for opening the primary passageway.

Next provided is the garment 216 having a back 244 with an inside 246 and an outside 248. The garment has a secondary passageway 250 vertically oriented and extending through the back of the garment. The garment has a left free end 252 and a right free end 254 defining the secondary passageway there between. Secondary hook and loop fasteners 256, 258 are provided on the inside adjacent to the left free end and on the inside adjacent to the right free end. The secondary hook and loop fasteners are adapted to couple together for closing the secondary passageway. The secondary hook and loop fasteners are adapted to separate for opening the secondary passageway. The secondary fasteners are optional.

Lastly, a first fabric section 262 and a second fabric section 264 are provided. The first fabric section and the second fabric section extend from the garment and define a tunnel 266 between the primary passageway and the secondary passageway. The showing in FIG. 9 of the fabrics sections are exaggerated for clarity. The sections and the tunnel are preferably as small as possible to hold the garment and the stuffed toy as close together as possible. First stitching 268 attaches the first fabric section to the stuffed animal inside the chamber laterally spaced from the left free edge. Second stitching 270 attaches the second fabric section to the garment on the back adjacent to the right free end. Converting to the stuffed animal is done through feeding the garment through the tunnel into the stuffed animal. Converting to the garment is done through withdrawing the garment through the tunnel from the stuffed animal.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stuffed animal and garment system (200) for providing a stuffed animal (214) with which to play and a garment (216) to wear, the system comprising, in combination:

a stuffed animal (214) having a front (215), a rear (218), an interior surface (220), and an exterior surface (222), the stuffed animal having a face, the stuffed animal having a primary passageway (224) vertically oriented and extending from a head of the stuffed animal through the rear of the stuffed animal, the stuffed animal having appendages being filed with stuffing, the stuffed animal having a left free edge (226) and a right free edge (228) defining the primary passageway there between, the stuffed animal having an interior chamber (230) with access to the chamber being through the primary passageway, primary fasteners (236) (238) on the interior surface adjacent to the left free edge and on the exterior surface adjacent to the right free edge, the primary fasteners adapted to couple together for closing the primary passageway, the primary fasteners adapted to separate for opening the primary passageway;

a garment (216) having a hood and a front and a back (244) with an inside (246) and an outside (248), the hood having upstanding hood ears, the upstanding hood ears being visible when viewed from the front and the back, the face of the stuffed animal having upstanding animal ears, the stuffed animal including the upstanding animal ears being visible when viewed from the back but totally not visible when viewed from the front, the face of the stuffed animal facing away from the hood and the front of the garment, the garment having two laterally spaced arm holes, the garment having a secondary passageway (250) vertically oriented and extending through the back of the garment, the primary passageway and the secondary passageway being located beneath the hood, the garment having a left free end (252) and a right free end (254) defining the secondary passageway there between, secondary fasteners adjacent to the secondary passageway; a flap with additional fasteners separably coupleable to the secondary fasteners to open and close the secondary passageway; and a first fabric section (262) and a second fabric section (264), the first fabric section and the second fabric section extending from the garment and defining a tunnel (266) between the primary passageway and the secondary passageway, first stitching (268) attaching the first fabric section to the stuffed animal inside the chamber laterally spaced from the left free edge, second stitching (270) attaching the second fabric section to the stuffed animal inside the chamber laterally spaced from the right free edge.

* * * * *